US008272856B2

(12) United States Patent
Fuchs et al.

(10) Patent No.: US 8,272,856 B2
(45) Date of Patent: Sep. 25, 2012

(54) HIGH-PRESSURE PUMP, IN PARTICULAR FOR A FUEL INJECTION APPARATUS OF AN INTERNAL COMBUSTION ENGINE

(75) Inventors: Walter Fuchs, Stuttgart (DE); Andreas Dutt, Stuttgart (DE); Jochen Aleker, Stuttgart (DE); Arnold Gente, Stuttgart (DE); Angelo Santamari, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 925 days.

(21) Appl. No.: 12/096,689

(22) PCT Filed: Nov. 15, 2006

(86) PCT No.: PCT/EP2006/068499

§ 371 (c)(1),
(2), (4) Date: Jun. 9, 2008

(87) PCT Pub. No.: WO2007/073985

PCT Pub. Date: Jul. 5, 2007

(65) Prior Publication Data

US 2008/0279707 A1 Nov. 13, 2008

(30) Foreign Application Priority Data

Dec. 23, 2005 (DE) ..... 10 2005 061 886

(51) Int. Cl.
*F04B 47/00* (2006.01)

(52) U.S. Cl. ..... 417/451; 417/454; 137/533.13; 137/539.5

(58) Field of Classification Search ..... 417/451, 417/454, 269, 364; 137/539, 539.5, 533.11, 137/533.13

See application file for complete search history.

(56) References Cited

U.S. PATENT DOCUMENTS 1,041,237 A * 10/1912 Budlong ..... 137/454.2

(Continued)

FOREIGN PATENT DOCUMENTS

DE 702 425 2/1941

(Continued)

*Primary Examiner* — Charles Freay
*Assistant Examiner* — Todd D Jacobs
(74) *Attorney, Agent, or Firm* — Michael Best & Friedrich LLP

(57) ABSTRACT

The high-pressure pump has at least one pump element which has a pump plunger which is driven in a reciprocating motion and defines a pump working space into which fuel is drawn in from a fuel feed via an inlet valve during the suction stroke of the pump plunger and from which fuel is displaced into a high-pressure region via an outlet valve during the delivery stroke of the pump plunger. The inlet valve and/or the outlet valve has a valve member at least approximately in the shape of a ball which acts as a sealing surface with a valve seat arranged in a valve housing. The valve member, in its open state, is lifted with its sealing surface from the valve seat, a first cross section of flow is cleared between the valve member and the valve seat, and downstream of the first cross section of flow, a second cross section of flow is formed between the valve member and the valve housing. In the direction of flow between the first cross section of flow and the second cross section of flow, a third cross section of flow is formed between the valve member and the valve housing, said third cross section of flow being larger than the first cross section of flow and the second cross section of flow.

22 Claims, 3 Drawing Sheets

U.S. PATENT DOCUMENTS

| | | | | |
|---|---|---|---|---|
| 3,735,777 | A | 5/1973 | Katzer et al. | |
| 4,692,102 | A | 9/1987 | Hafele et al. | |
| 5,183,075 | A | 2/1993 | Stein | |
| 5,251,664 | A | 10/1993 | Arvidsson et al. | |
| 7,318,556 | B2 * | 1/2008 | Lee et al. | 239/572 |
| 7,780,144 | B2 * | 8/2010 | Van Der Linden et al. | 251/359 |

FOREIGN PATENT DOCUMENTS

| | | | |
|---|---|---|---|
| DE | 202 13 168 | U1 | 1/2004 |
| GB | 2 107 000 | A | 4/1983 |
| WO | WO 91/12450 | A1 | 8/1991 |
| WO | WO 2005/078273 | A1 | 8/2005 |

* cited by examiner

HIGH-PRESSURE PUMP, IN PARTICULAR FOR A FUEL INJECTION APPARATUS OF AN INTERNAL COMBUSTION ENGINE

CROSS-REFERENCE TO RELATED APPLICATION

This application is a 35 USC 371 application of PCT/EP2006/068499 filed on Nov. 15, 2006.

BACKGROUND OF THE INVENTION

1. Field of the Invention

The invention is based on a high-pressure pump, in particular for a fuel injection apparatus of an internal combustion engine.

2. Description of the Prior Art

A high-pressure pump of this kind is known from DE 102004027825 A1. This high-pressure pump has at least one pump element equipped with a pump piston that is driven into a stroke motion and delimits a pump working chamber. During the suction stroke of the pump piston, fuel is drawn from a fuel inlet via an inlet valve and during the delivery stroke of the pump piston, fuel is displaced from the pump working chamber via an outlet valve into a high-pressure region, for example a reservoir. The outlet valve has a valve member at least approximately in the form of a ball, a part of whose upper surface, functioning as a sealing surface, cooperates with a valve seat situated in a valve housing. In the open state when the sealing surface of the valve member is lifted away from the valve seat, the valve member opens a first flow cross section between the valve member and the valve housing. Downstream of the sealing surface, a second flow cross section is formed between the valve member and the valve housing. The outlet valve is embodied so that in the open state of the valve, the second flow cross section between the valve member and the valve housing is smaller than the first flow cross section situated in the vicinity of the sealing surface of the valve member. As a result of this, there is a lower flow speed and therefore a higher static pressure in the region of the sealing surface of the valve member than in the region of the second flow cross section. This improves the flow through the valve since the valve member opens in a stable fashion. Due to the hydraulic forces produced, however, the outlet valve can have a tendency to vibrate in some circumstances so that the outlet valve does not remain open in a stable fashion but instead opens and closes several times, interfering with the operating behavior of the high-pressure pump and causing a significant amount of strain on the high-pressure pump due to pressure peaks that occur in the pump working chamber when the outlet valve is closed. This also leads to a large amount of wear on the valve member and/or the valve seat. Moreover, the valve member can also execute movements perpendicular to its stroke direction, causing the valve member to strike the valve seat from different directions during the closing of the valve, which likewise leads to a large amount of wear.

SUMMARY AND ADVANTAGES OF THE INVENTION

The high-pressure pump according to the invention has the advantage over the prior art that the flow through the inlet valve and/or the outlet valve is further improved and an inexpensive ball is used as the valve member. The enlarged third flow cross section provided here achieves a particularly stable opening of the inlet valve and outlet valve since the compressive force acting on the valve member in the opening direction is further increased in the region of the third flow cross section. As a result, in addition to improving the flow through the valve, this also improves the service life of its components and therefore of the high-pressure pump as a whole. The enhanced flow through the valve improves the filling of the pump working chamber and the high-pressure region.

The invention simplifies the manufacture of the valve since it is unnecessary to manufacture any undercut in the valve housing in order to produce the third flow cross section that is larger than the second flow cross section. One embodiment achieves a reliable guidance of the valve member so that it is unable to execute any uncontrolled movements perpendicular to its stroke direction, thus making it possible to minimize the wear on the valve member and valve seat. An insert piece according to the invention can simultaneously function as a support for a closing spring acting on the valve member. It is also possible to prevent uncontrolled movements of the valve member perpendicular to its stroke direction.

BRIEF DESCRIPTION OF THE DRAWINGS

Two exemplary embodiments of the invention are shown in the drawings and will be explained in detail below.

DESCRIPTION OF THE PREFERRED EMBODIMENTS

Figure 1:
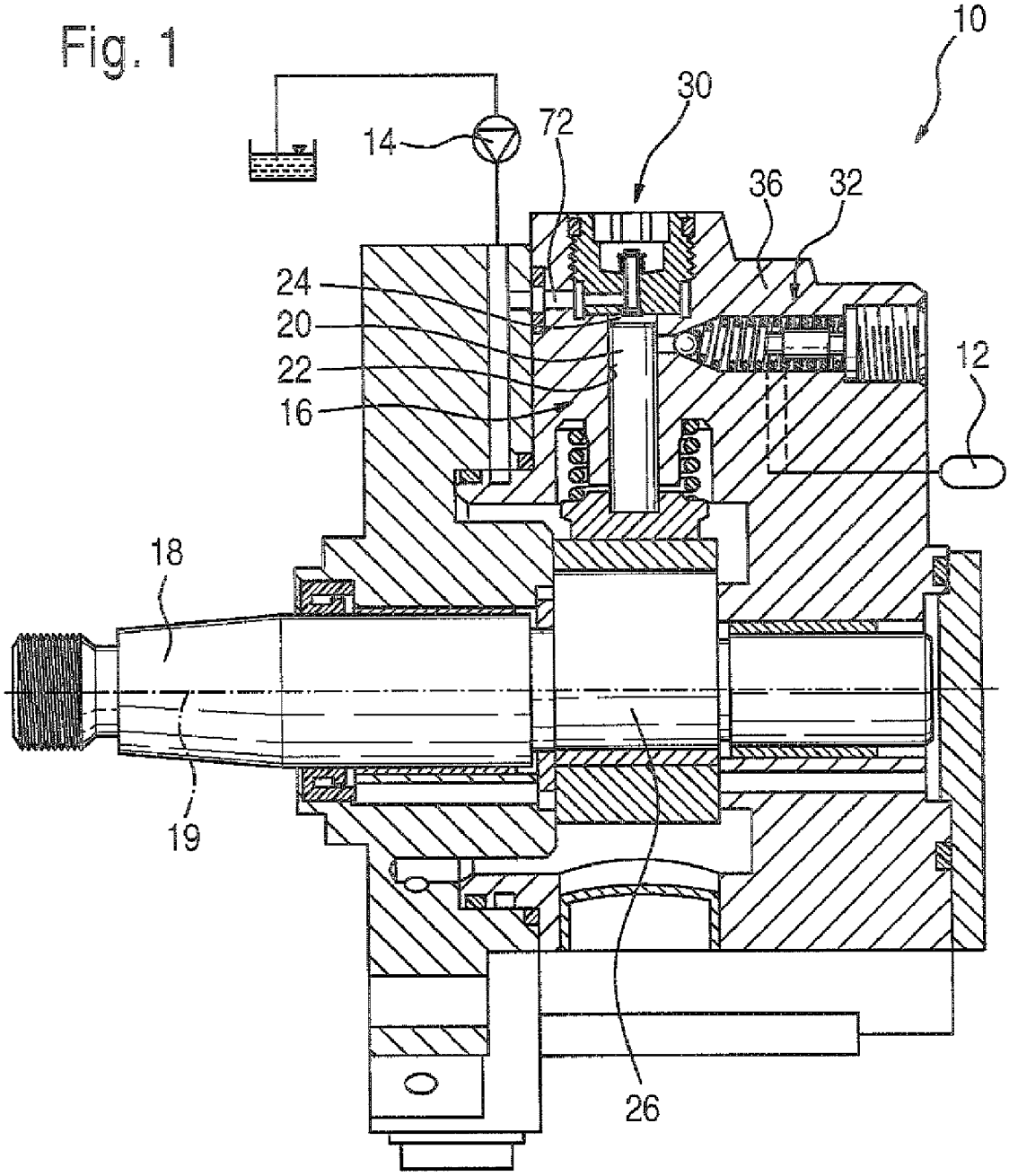
FIG. 1 shows a longitudinal section through a high-pressure pump for a fuel injection apparatus of an internal combustion engine.

FIG. 1 shows a high-pressure pup 10 for a fuel injection apparatus of internal combustion engine that is preferably embodied in the form of an autoignition internal combustion engine. The high-pressure pump 10 delivers highly pressurized fuel to a reservoir 12 from which fuel is drawn for injection into the internal combustion engine. A fuel delivery pump 14 supplies fuel to the high-pressure pump 10. The high-pressure pump 10 has at least one pump element 16 that has a pump piston 20 driven at least indirectly into a stroke motion by a drive shaft 18 of the high-pressure pump 10. The pump piston 20 is guided in a sealed fashion in a cylinder bore 22 extending at least approximately radially in relation to the drive shaft 18 and delimits a pump working chamber 24 in the outer end region of the cylinder bore 22 oriented away from the drive shaft 18. The drive shaft 18 has a cam or a shaft section 26 eccentric to its rotation axis 19 that produces the stroke motion of the pump piston 20 with the rotary motion of the drive shaft 18. The pump working chamber 24 can be connected to a fuel inlet coming from the fuel delivery pump 14 by means of an inlet valve 30 embodied in the form of a check valve, which opens toward the pump working chamber 24. The pump working chamber 24 can also be connected to a fuel outlet, which leads to the reservoir 12, by means of an outlet valve 32 embodied in the form of a check valve that opens away from the pump working chamber 24. During the suction stroke, the pump pistol 20 in the cylinder bore 22 moves radially inward so that the volume of the pump working chamber 24 is increased. During the suction stroke of the pump piston 20, the inlet valve 30 is opened due to the resulting pressure difference since the fuel delivery pump 14 generates a pressure that is higher than the pressure prevailing in the pump working chamber 24 so that fuel supplied by the fuel supply pump 14 is sucked into the pump working chamber 24. During the suction stroke of the pump piston 20, the outlet valve 32 is closed since a higher pressure prevails in the reservoir 12 than in the pump working chamber 24.

Figure 2:
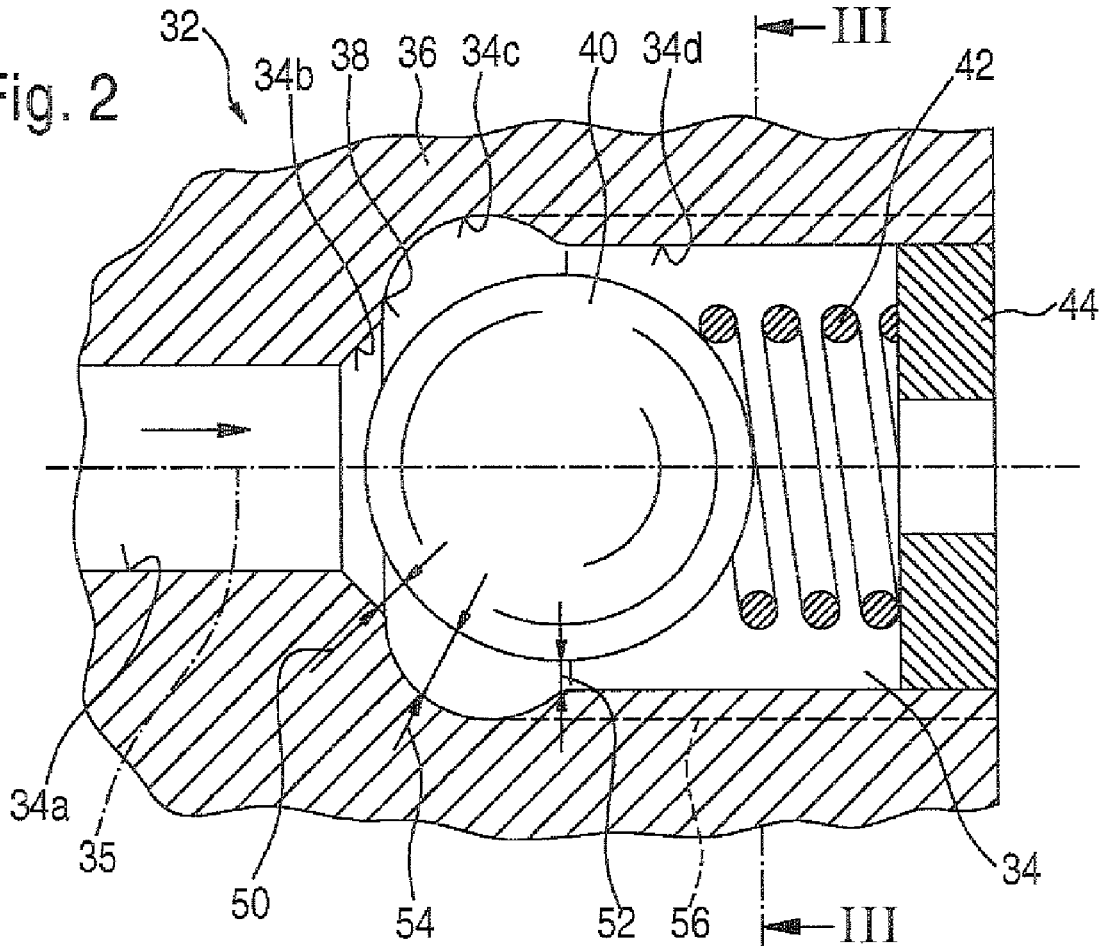
FIG. 2 shows an enlarged longitudinal section through a first exemplary embodiment of an outlet valve of the high-pressure pump in the open state.

By way of example, the outlet valve 32 will be described in greater detail below in conjunction with FIG. 2. For example, the outlet valve 32 is inserted into a bore 34 of a housing part 36 of the high-pressure pump; the bore 34 opens into the cylinder bore 22 approximately radial to the longitudinal axis of the cylinder bore 22, for example. In this case, the bore 34 has regions with different diameters; an end region 34*a* of the bore 34 opening out into the cylinder bore 22 has the smallest diameter. At its other end oriented away from the cylinder bore 22, the end region 34*a* is adjoined by another region 34*b* whose diameter increases in the direction oriented away from the cylinder bore 22. The region 34*b* can, for example, be embodied as at least approximately the shape of a truncated cone and constitutes a valve seat for a valve member of the outlet valve 32, which valve member will be described in greater detail below. At its end oriented away from the cylinder bore 22, the seat region 34*b* is adjoined by another region 34*c* that has a significantly larger diameter than the end region 34*a* and the seat region 34*b*. This yields an annular shoulder 38 oriented away from the cylinder bore 22 at the transition from the seat region 34*b* to the region 34*c*. The transition from the annular shoulder 38 to the region 34*c* can, for example, be rounded as shown in FIG. 2. At its end oriented away from the cylinder bore 22, the region 34*c* is adjoined by a region 34*d* whose diameter is smaller than the diameter of the region 34*c*. The transition from the region 34*c* to the region 34*d* can, for example, be rounded or can be embodied approximately in the form of a truncated cone. In relation to the region 34*d*, the region 34*c* consequently constitutes an undercut in the bore 34. All of the regions 34*a*, 34*b*, 34*c*, 34*d* of the bore 34 are embodied coaxial to the longitudinal axis 35 of the bore 34. The region 34*d* of the bore 34 is connected to the high-pressure reservoir 12.

The outlet valve 32 has a valve member 40 embodied at least approximately in the form of a ball that is situated in the bore 34 and cooperates with the seat region 34*b*. The diameter of the valve member 40 is slightly smaller than the diameter of the region 34*d* of the bore 34 so that the valve member 40 is able to move in the direction of the longitudinal axis 35 of the bore 34. The valve member 40 can, for example, be acted on in the direction toward the seat region 34*b* by a prestressed spring 42. The spring 42 can, for example, be embodied in the form of a helical compression spring and be clamped between the valve member 40 and a support element 44 inserted into the bore 34.

When the outlet valve 32 is closed, the valve member 40 rests with a part of its surface, which constitutes a sealing surface, against the seat region 34*b* of the bore 34. If the force acting on the valve member 40 in the opening direction that is generated by the pressure prevailing in the pump working chamber 24 is greater than the force acting on a valve member 40 in the closing direction that is generated by the closing spring 42 and by the pressure prevailing in the high-pressure reservoir 12, then the outlet valve 32 opens and the valve member 40 lifts away from the seat region 34*b*. The stroke direction of the valve member 40 is oriented in the direction of the longitudinal axis 35 of the bore 34. This lifting movement opens a first flow cross section 50 for the fuel between the seat region 34*b* and the valve member 40; this first flow cross section depends on the opening stroke of the valve member 40 and increases in magnitude with the increasing opening stroke. The first flow cross section 50 is embodied in the form of an annular gap between the valve member 40 and the seat region 34*b*. Between the region 34*d* of the bore 34 and the valve member 40, a second flow cross section 52 is opened that is independent of or only slightly dependent on the opening stroke of the valve member 40. Between the first flow cross section 50 and the second flow cross section 52, a third flow cross section 54 is opened between the region 34*c* of the bore 34 and the valve member 40; this third flow cross section 54 depends on the opening stroke of the valve member 40, i.e. it increases in magnitude with the increasing opening stroke, but is always greater than the first flow cross section 50 and the second flow cross section 52. The third flow cross section 54 is embodied in the form of an annular gap between the valve member 40 and the bore region 34*c*. Preferably, the second flow cross section 52 is smaller than the first flow cross section 50 when the valve member 40 has traveled the length of its given maximum opening stroke. This embodiment of the flow cross sections 50, 52, 54 results in the fact that when the outlet valve 32 is open, essentially the entire half of the valve member 40 oriented toward the cylinder bore 22 is acted on by a high average pressure that holds the valve member 40 in its open position in a stable fashion. In particular, the surface of the valve member 40 situated in the region 34*c* of the bore 34 is acted on by a high pressure since in this third and largest flow cross section 54, the lowest flow speed occurs and therefore the highest static pressure prevails.

Figure 3:
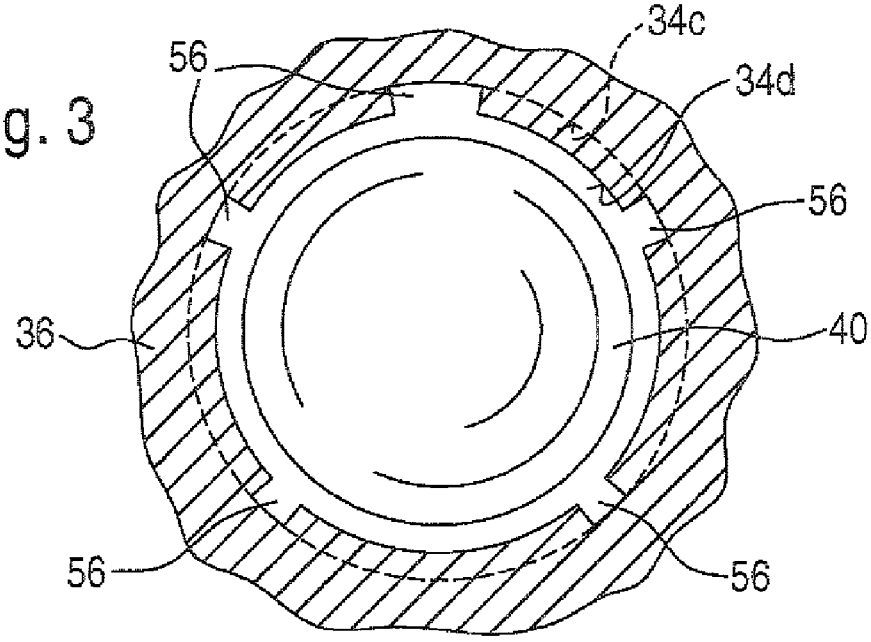
FIG. 3 shows a cross section through the outlet valve in FIG. 2, along line III-III.

It is possible for the valve member 40 to be situated at least approximately coaxially in the region 34*d* of the bore 34 and for the second flow cross section 52 to be embodied in the for of an annular gap between the valve member 40 and the bore region 34*d*. It is also possible for the second flow cross section 52 to be embodied as asymmetrical over the circumference of the valve member 40 so that the valve member 40 is intentionally held with a particular circumference region resting against a guide in the region 34*d* of the bore 34. This avoids movements of the valve member 40 perpendicular to its stroke direction since the valve member 40 is kept in contact with the guide. The region 34*d* of the bore 34 can be provided with slots 56 that extend approximately parallel to the longitudinal axis 35 and are arranged uniformly or non-uniformly around the circumference of the bore 34, as shown in FIG. 3. With uniformly distributed slots 56, the valve member 40 can be positioned with a small amount of play transverse to its stroke direction in the bore region 34*d*. The play of the valve member 40 transverse to its stroke direction in the bore region 34*d* can be less than or equal to approximately 10% of the diameter of the valve member 40. With non-uniformly distributed slots 56, a larger compressive force is exerted in a circumference region that contains more slots 56 or wider slots, thus holding the valve member 40 in contact with the opposite circumference region of the bore region 34*d*, which consequently functions as a guide for the valve member 40.

Figure 4:
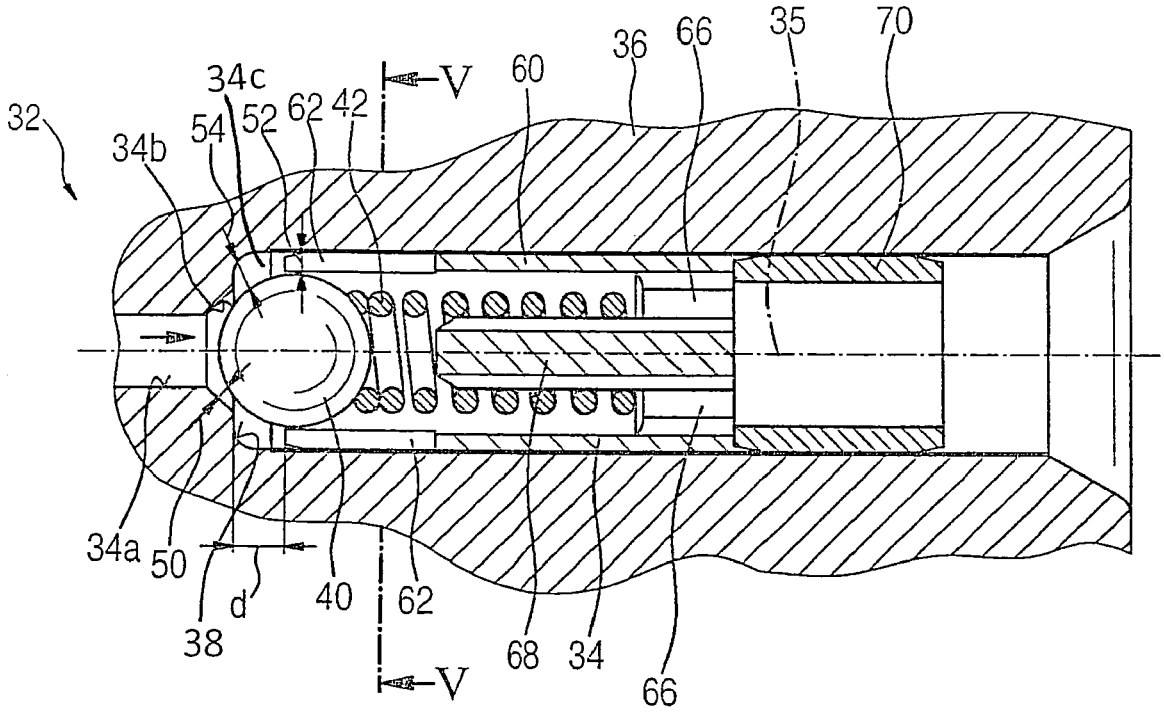
FIG. 4 shows a longitudinal section through a second exemplary embodiment of an outlet valve in the open state.
Figure 5:
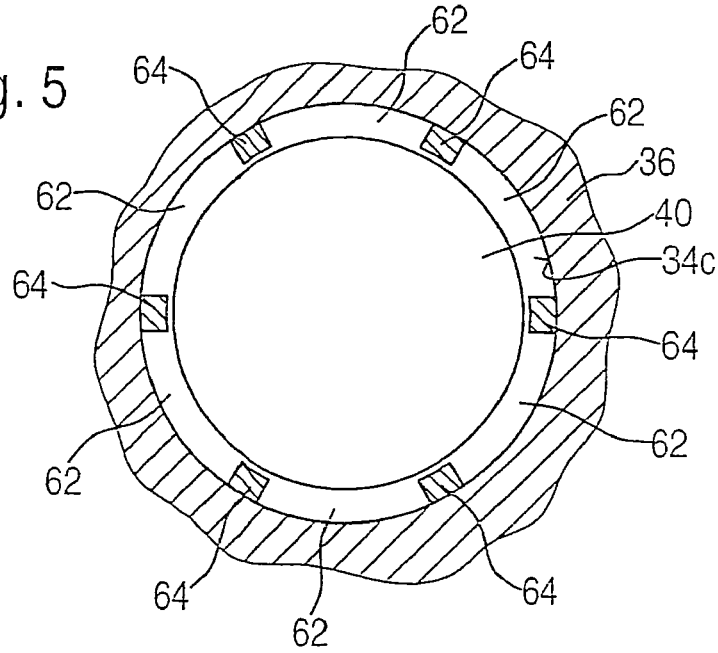
FIG. 5 shows a cross section through the outlet valve in FIG. 4, along line V-V.

FIGS. 4 and 5 show the outlet valve 32 according to a second exemplary embodiment in which the basic embodiment with the three defined flow cross sections 50, 52, 54 is the same as in the first exemplary embodiment. The pump housing pan 36 contains the bore 34 whose end region 34*a* opens out into the cylinder bore 22 and the end region 34*a* oriented away from the cylinder bore 22 is adjoined by the seat region 34*b*. The end of the seat region 34*b* oriented away from the cylinder bore 22 is adjoined by a bore region 34*c* with a diameter significantly larger than that of the end region 34*a*; the annular shoulder 38 is formed at the transition from the seat region 34*b* to the bore region 34*c*. The bore region 34*c* has a separate insert piece 60 inserted into it, which is embodied in the form of a sleeve and ends a certain distance a before the annular shoulder 38 in the direction of the longitudinal axis 35 of the bore 34. In its end region oriented toward seat region 34*b*, the insert piece 60 has a number of slots 62 distributed over its circumference, extending at least approximately parallel to the longitudinal axis 35 of the bore 34. On the basis of the slots 62, a corresponding number of ribs 64 are formed at the end region of the insert piece 60. The slots 62 and ribs 64 can be distributed uniformly or, as shown in FIG. 5, non-uniformly around the circumference of the insert piece 60. With a non-uniformly distributed arrangement of the ribs 64, the valve member 40 is selectively held in contact with at least one of the ribs 64, which rib or ribs consequently function(s) as a guide for the valve member 40. The second flow cross section 52 is formed between the valve member 40 and the insert piece 60; the size of the second flow cross section 52 is determined by the width of the slots 62 and the radial distance between the valve member 40 and the ribs 64.

If the ribs 64 are uniformly distributed, then the valve member 40 is preferably guided in a movable fashion, with a small amount of play transverse to its stroke direction between the ribs 64 of the insert piece 60, permitting the valve member 40 to execute little or no movement perpendicular to its stroke direction. The play of the valve member 40 transverse to its stroke direction between the ribs 64 can, for example, be less than 10% of the diameter of the valve member 40. The third flow cross section 54 is formed between the valve member 40 and the part of the bore region 34*c* that extends to the insert piece 60 and has the length d in the direction of the longitudinal axis 35. Compared to the embodiment according to the first exemplary embodiment, the embodiment of the outlet valve 32 according to the second exemplary embodiment has the advantage that the bore region 34*c* can be embodied with a constant diameter, thus requiring no undercut in the bore 34 in order to achieve the third flow cross section 54 that is larger than the second flow cross section 52 since the second flow cross section 52 is defined by the insert piece 60.

In its end region oriented away from the valve member 40, the insert piece 60 is provided with openings 66 to permit fuel to pass through. An arbor 68 is provided in the insert piece 60, coaxial to the longitudinal axis 35 and preferably of one piece with the insert piece 60. The closing spring 42 is supported on the insert piece 60 and is guided on the arbor 68. The end of the arbor 68 oriented toward the valve member 40 preferably constitutes a stop for the valve member 40, which the valve member comes into contact with when it reaches its maximum opening stroke. The insert piece 60 can itself be affixed in the bore region 36*c* by being press-fitted or screwed, for example, into the bore region 34*c*. Alternatively, the insert piece 60 can also be affixed by means of an additional fastener 70 that can be press-fitted or screwed, for example, into the bore region 34*c*. The fastener 70 in this case has at least one opening to allow fuel to pass through. Alternatively, it is also possible for the closing spring 42 to be supported on a support element other than the insert piece 60, which support element is provided in addition to the insert piece 60.

The inlet valve 30 can be embodied in the same way as described above for the outlet valve 32. The inlet valve 30 is situated in the housing part 36 of the high-pressure pump; this housing part can, for example, be constituted by a cylinder head that is connected to another housing part in which the drive shaft 18 is supported or can be constituted by the very housing part in which the drive shaft 18 is also supported. A fuel supply conduit 72 that is connected to the fuel supply pump 14 leads to the inlet valve 30.

In a high-pressure pump, it is possible for only the outlet valve 32 to be embodied in the fashion described in FIGS. 2 through 5, while the inlet valve 30 has a different embodiment. Alternatively, it is also possible for only the inlet valve 30 of a high-pressure pump to be embodied in the fashion described in FIGS. 2 through 5, while the outlet valve 32 has a different embodiment. Furthermore, it is also possible for both the inlet valve 30 and the outlet valve 32 in a high-pressure pump to be embodied in the fashion described in FIGS. 2 through 5.

The foregoing relates to the preferred exemplary embodiment of the invention, it being understood that other variants and embodiments thereof are possible within the spirit and scope of the invention, the latter being defined by the appended claims.

The invention claimed is:

1. A high-pressure pump, in particular for a fuel injection apparatus of an internal combustion engine, comprising:

at least one pump element;

a pump piston of the pump element that is driven to execute a stroke motion;

a pump working chamber of the pump element being delimited by the pump piston;

a fuel supply from which fuel is drawn into the pump working chamber during a suction stroke of the pump piston;

an inlet valve comprising a valve housing having interior side walls through which the fuel is drawn from the fuel supply into the pump working chamber;

a high-pressure region into which the fuel is displaced from the pump working chamber during a delivery stroke of the pump piston;

an outlet valve comprising a valve housing having interior side walls through which the fuel is displaced from the pump working chamber into the high-pressure region;

said inlet valve and/or said outlet valve each having a valve member that defines a sealing surface which is at least approximately as a ball having a diameter;

said inlet valve and/or/outlet valve each including a valve seat in said housing that cooperates with the sealing surface of the valve member thereby blocking flow therethrough; said valve member disposed in said housing to have an initial movement and a subsequent movement;

a first flow cross section formed between the sealing surface of the valve member and the valve seat when the sealing surface of the valve member is lifted away from the valve seat in an open state during said initial movement;

a second flow cross section downstream of the first flow cross section, formed between the diameter of said sealing surface of the valve member and a separate insert piece mounted in the valve housing during said subsequent movement between which defines said second flow cross section;

said separate insert piece is disposed downstream of said valve seat a distance such that said second flow cross section is reached only during said subsequent movement of said valve member;

a third flow cross section formed between the sealing surface of the valve member and the interior side walls of the valve housing only during said initial movement in the flow direction between the first flow cross section and the second flow cross section, wherein the third flow cross section is larger than the first flow cross section and the second flow cross section; and wherein the second flow cross section is smaller than the first flow cross section when the diameter of the valve member aligns with said second flow cross section.

2. The high-pressure pump according to claim 1, wherein in a region of the third flow cross section, a cross-sectional expansion of the valve housing creates an undercut in relation to the second flow cross section in the valve housing encompassing the valve member.

3. The high-pressure pump according to claim 1, wherein the valve housing has a bore in which the insert piece is accommodated and the insert piece is embodied as a sleeve.

4. The high-pressure pump according to claim 2, wherein the valve housing has a bore in which the insert piece is accommodated and the insert piece is embodied as a sleeve.

5. The high-pressure pump according to claim 1, wherein the valve member is guided so that it is able to move in its stroke direction inside the insert piece and has a small amount of play transverse to its stroke direction.

6. The high-pressure pump according to claim 3, wherein the valve member is guided so that it is able to move in its stroke direction inside the insert piece and has a small amount of play transverse to its stroke direction.

7. The high-pressure pump according to claim 1, wherein the insert piece supports a closing spring that acts on the valve member in the closing direction.

8. The high-pressure pump according to claim 6, wherein the insert piece supports a closing spring that acts on the valve member in the closing direction.

9. The high-pressure pump according to claim 5, wherein the insert piece supports a closing spring that acts on the valve member in the closing direction.

10. The high-pressure pump according to claim 1, wherein the insert piece has a plurality of ribs encompassing the valve member between which the second flow cross section is formed and the ribs are distributed asymmetrically over the circumference of the valve member so that the valve member is held in contact with at least one of the ribs in a direction transverse to its stroke direction.

11. The high-pressure pump according to claim 8, wherein the insert piece has a plurality of ribs encompassing the valve member between which the second flow cross section is formed and the ribs are distributed asymmetrically over the circumference of the valve member so that the valve member is held in contact with at least one of the ribs in a direction transverse to its stroke direction.

12. The high-pressure pump according to claim 9, wherein the insert piece has a plurality of ribs encompassing the valve member between which the second flow cross section is formed and the ribs are distributed asymmetrically over the circumference of the valve member so that the valve member is held in contact with at least one of the ribs in a direction transverse to its stroke direction.

13. The high-pressure pump according to claim 7, wherein the insert piece has a plurality of ribs encompassing the valve member between which the second flow cross section is formed and the ribs are distributed asymmetrically over the circumference of the valve member so that the valve member is held in contact with at least one of the ribs in a direction transverse to its stroke direction.

14. The high-pressure pump according to claim 1, wherein the second flow cross section is embodied as asymmetrical over the circumference of the valve member so that the valve member is held in contact with a guide in a direction transverse to its stroke direction.

15. The high-pressure pump according to claim 11, wherein the second flow cross section is embodied as asymmetrical over the circumference of the valve member so that the valve member is held in contact with a guide in a direction transverse to its stroke direction.

16. The high-pressure pump according to claim 12, wherein the second flow cross section is embodied as asymmetrical over the circumference of the valve member so that the valve member is held in contact with a guide in a direction transverse to its stroke direction.

17. The high-pressure pump according to claim 13, wherein the second flow cross section is embodied as asymmetrical over the circumference of the valve member so that the valve member is held in contact with a guide in a direction transverse to its stroke direction.

18. The high-pressure pump according to claim 10, wherein the second flow cross section is embodied as asymmetrical over the circumference of the valve member so that the valve member is held in contact with a guide in a direction transverse to its stroke direction.

19. The high-pressure pump according to claim 4, wherein the valve member is guided so that it is able to move in its stroke direction inside the insert piece and has a small amount of play transverse to its stroke direction.

20. The high-pressure pump according to claim 19, wherein the insert piece supports a closing spring that acts on the valve member in the closing direction.

21. The high-pressure pump according to claim 20, wherein the insert piece has a plurality of ribs encompassing the valve member between which the second flow cross section is formed and the ribs are distributed asymmetrically over the circumference of the valve member so that the valve member is held in contact with at least one of the ribs in a direction transverse to its stroke direction.

22. The high-pressure pump according to claim 21, wherein the second flow cross section is embodied as asymmetrical over the circumference of the valve member so that the valve member is held in contact with a guide in a direction transverse to its stroke direction.

* * * * *